US008096540B2

(12) United States Patent
Claxton

(10) Patent No.: US 8,096,540 B2
(45) Date of Patent: Jan. 17, 2012

(54) TENSION RING LIFTING ASSEMBLY

(76) Inventor: Dannie Claxton, Great Yarmouth (GB)

( * ) Notice: Subject to any disclaimer, the term of this patent is extended or adjusted under 35 U.S.C. 154(b) by 183 days.

(21) Appl. No.: 12/500,293

(22) Filed: Jul. 9, 2009

(65) Prior Publication Data

US 2010/0006807 A1 Jan. 14, 2010

(51) Int. Cl.
*B25B 1/02* (2006.01)

(52) U.S. Cl. ..... 269/188; 269/190; 269/89; 269/95; 269/58

(58) Field of Classification Search ..... 269/89, 269/95, 58, 188, 190; 81/57.15, 57.33, 57.17; 294/102.2, 90, 91, 119.2; 74/813 R–813 L, 74/526, 527; 166/75.14, 88.2, 77.51; 175/423
See application file for complete search history.

(56) References Cited

U.S. PATENT DOCUMENTS

| | | | | |
|---|---|---|---|---|
| 1,341,957 | A * | 6/1920 | Wilson | 294/90 |
| 1,630,732 | A * | 5/1927 | Davidson | 175/423 |
| 1,907,685 | A * | 5/1933 | Tilbury | 175/423 |
| 1,908,652 | A * | 5/1933 | Adair | 175/423 |
| 2,217,072 | A * | 10/1940 | Nixon | 175/423 |
| 2,245,979 | A * | 6/1941 | Johnson | 175/423 |
| 3,675,278 | A | 7/1972 | Powell | |
| 4,428,433 | A | 1/1984 | Watkins | |
| 4,823,919 | A | 4/1989 | Hayatdavoudi | |
| 4,940,118 | A | 7/1990 | Cox | |
| 5,148,871 | A | 9/1992 | Gullion | |
| 5,755,289 | A * | 5/1998 | Angman et al. | 166/378 |
| 6,378,399 | B1 | 4/2002 | Bangert | |

(Continued)

FOREIGN PATENT DOCUMENTS

| | | | |
|---|---|---|---|
| GB | 218823 | A | 7/1924 |

(Continued)

OTHER PUBLICATIONS

European Search Report, EP 09 16 5088, mailed Nov. 5, 2009.
UK Search Report, Application No. GB 0812531, searched on Nov. 25, 2008.

*Primary Examiner* — George Nguyen
(74) *Attorney, Agent, or Firm* — Choate, Hall & Stewart, LLP; Brenda Herschbach Jarrell

(57) ABSTRACT

A tension ring lifting assembly (101) for securing around a pipe, the assembly comprising a tension ring (112) and at least one lifting lug (130) by which the tension ring, and a pipe around which the tension ring has been secured, can be lifted. The tension ring comprises: a plurality of collar segments (114, 116) which can be assembled into a ring around the pipe; a plurality of slip segments (140) adapted to fit between the collar segments and the pipe and to make direct contact with the pipe surface, the collar segments and the slip segments when assembled having inclined contacting surfaces such that an inner diameter across said assembled ring, between the inner faces of the collar segments, varies as the segments move up and down in the collar; means for tensioning (152, 154, 156) adjacent collar segments (114, 116) against one another to secure said ring around the pipe; and means for removeably mounting (7, 9) said at least one lifting lug (130) to the tension ring (140). Prior to mounting of the lifting lug, the tension ring has an outer diameter that is less than the diameter of the tension ring lifting assembly after mounting of the lifting lug to the tension ring. This enables the tension ring to be fitted with a relatively small outer diameter so that the tension ring can pass through an opening before the lifting lugs are fitted.

15 Claims, 8 Drawing Sheets

U.S. PATENT DOCUMENTS

| | | | | |
|---|---|---|---|---|
| 7,419,000 | B1 * | 9/2008 | Marsh | 166/77.51 |
| 7,681,649 | B2 * | 3/2010 | Cerovsek | 166/382 |
| 2004/0055421 | A1 | 3/2004 | Bangert | |
| 2004/0182611 | A1 * | 9/2004 | Ramey et al. | 175/423 |
| 2005/0155797 | A1 * | 7/2005 | Campisi | 175/423 |
| 2009/0056930 | A1 * | 3/2009 | Angelle et al. | 166/77.51 |

FOREIGN PATENT DOCUMENTS

| | | | |
|---|---|---|---|
| GB | 262310 | A | 12/1926 |
| GB | 1417883 | | 12/1975 |

* cited by examiner

TENSION RING LIFTING ASSEMBLY

RELATED APPLICATIONS

This application claims priority to United Kingdom patent application serial number GB 0812531.2, filed on Jul. 9, 2008, the disclosure of which incorporated herein by reference in its entirety.

FIELD OF THE INVENTION

This invention relates to a tension ring adapted to be clamped around a pipe to enable the pipe to be gripped and to enable ancillary devices to be attached to the pipe. The ring is particularly intended for mounting on a conductor riser pipe which is part of an offshore oil and gas production or exploration facility.

BACKGROUND

One particular application is for drilling conductors where ancillary devices, in particular lifting lugs, have to be securely attached around the conductor before the conductor is lowered through the rotary table on an offshore rig. Known tension rings have a relatively large diameter and cannot pass through the opening in the table with the result that the ring has to be mounted on the pipe below the table.

SUMMARY OF THE INVENTION

The ring of the invention will normally be used to engage with vertically positioned pipes and as a result the plane of the ring will be horizontal. References in this specification to top and bottom, up and down, horizontal and vertical are to be read accordingly, but are not to be taken as limiting the scope of the invention.

According to the invention, there is provided a tension ring lifting assembly for securing around a pipe, the assembly comprising a tension ring and at least one lifting lug by which the tension ring, and a pipe around which the tension ring has been secured, can be lifted, the tension ring comprising:

- a plurality of collar segments which can be assembled into a ring around the pipe;
- a plurality of slip segments adapted to fit between the collar segments and the pipe and to make direct contact with the pipe surface, the collar segments and the slip segments when assembled having inclined contacting surfaces such that an inner diameter across said assembled ring, between the inner faces of the collar segments, varies as the segments move up and down in the collar;
- means for tensioning adjacent collar segments against one another to secure said ring around the pipe; and
- means for removeably mounting said at least one lifting lug to the tension ring;
- wherein, prior to said mounting of said at least one lifting lug, the tension ring has an outer diameter that is less than the diameter of the tension ring lifting assembly after mounting of said at least one lifting lug to the tension ring. In one preferred embodiment of the invention, the means for removeably mounting the (or each) lifting lug to the tension ring may comprise at least one bolt and at least one corresponding threaded bore in a collar segment by which the (or each) lifting lug can be removeably bolted to a corresponding collar segment.

In an alternative preferred embodiment of the invention, the means for removeably mounting the (or each) lifting lug to the tension ring comprises at least one recess in a collar segment and at least one mating projection in the (or each) lifting lug by which the (or each) lifting lug can be removeably affixed to a corresponding collar segment. The recess may be a vertically extending dovetail slot and the lug may have a corresponding dovetail formation which can slide into the recess from below but which ends in a base which will not enter the slot and through which a lifting load will be transferred to the tension ring.

The means for tensioning adjacent collar segments against one another may comprise at least one screw fixing which when tightened pulls adjacent collar segments together.

In one preferred embodiment of the invention, the tension ring lifting assembly may comprise additionally at least one pair of clamp bodies which can be engaged with each other and with two adjacent collar segments and tensioned against one another to further secure the collar segments around the pipe. The clamps are initially separate from the collar segments and the engagement between the assembled collar segments, the slip segments and the pipe is sufficient to provide enough grip for the tension ring to be held in position around the pipe as the pipe is raised and lowered with its axis vertical. Thus, the tension ring can be set in position around a pipe and then passed through an opening of a size just larger than the tension ring, with the clamp bodies being put in place and clamped up after the tension ring has passed through the opening.

Preferably the assembled collar has two collar segments, each in the form of an annular arc extending over a semicircle. The collar segments can have enlarged shoulders at their adjoining ends, and clamp bodies can locate against the shoulders to pull the collar segments towards one another. The clamp bodies are preferably provided with bolts which can be tightened to draw the bodies towards one another.

The tension ring may also have a retaining plate associated with each collar segment, and means may be provided in the retaining plates to support the slip segments in their uppermost position when initially locating the tension ring around a pipe. The supporting means can then be operated to release the segments.

The means for tensioning adjacent collar segments against one another to secure the tension ring around the pipe may be adapted to provide a pre-tension of the collar segments prior to full tensioning of the collar segments so that slip segments are held in direct contact with the pipe surface prior to removeably mounting the (or each) lifting lug to the tension ring.

The means for pre-tensioning the collar segments may comprises at least one bolt that pulls adjacent collar segments together.

Also according to the invention, there is provided a method of securing a tension ring lifting assembly around a pipe, the assembly comprising a tension ring and at least one lifting lug by which the tension ring, and a pipe around which the tension ring has been secured, can be lifted, the method comprising:

- assembling a plurality of collar segments into a ring around the pipe;
- fitting a plurality of slip segments between the collar segments and the pipe to make direct contact with the pipe surface, the collar segments and the slip segments when assembled having inclined contacting surfaces such that an inner diameter across said assembled ring, between the inner faces of the slip segments, varies as the slip segments move up and down inside said assembled collar segments;
- tensioning adjacent collar segments against one another to secure said ring around the pipe;

providing an apparatus separate from the tension ring lifting assembly, said apparatus having a body and in the body a through hole;

passing said secured tension ring and pipe through said hole and then mounting said at least one lifting lug to the tension ring to complete the assembly of the tension ring lifting assembly;

wherein, after said mounting of said at least one lifting lug, the tension ring has an outer diameter that is greater than the diameter of the tension ring lifting assembly prior to mounting of said at least one lifting lug to the tension ring such that the secured tension ring lifting assembly and pipe may not pass back through said through hole.

The method may include after passing the secured tension ring and pipe through the hole, the step of applying additional tension between adjacent collar segments to further secure the tension ring around the pipe.

BRIEF DESCRIPTIONS OF THE DRAWINGS

The invention will now be further described, by way of example only, with reference to the accompanying drawings, in which.

DETAILED DESCRIPTION

Figure 2:
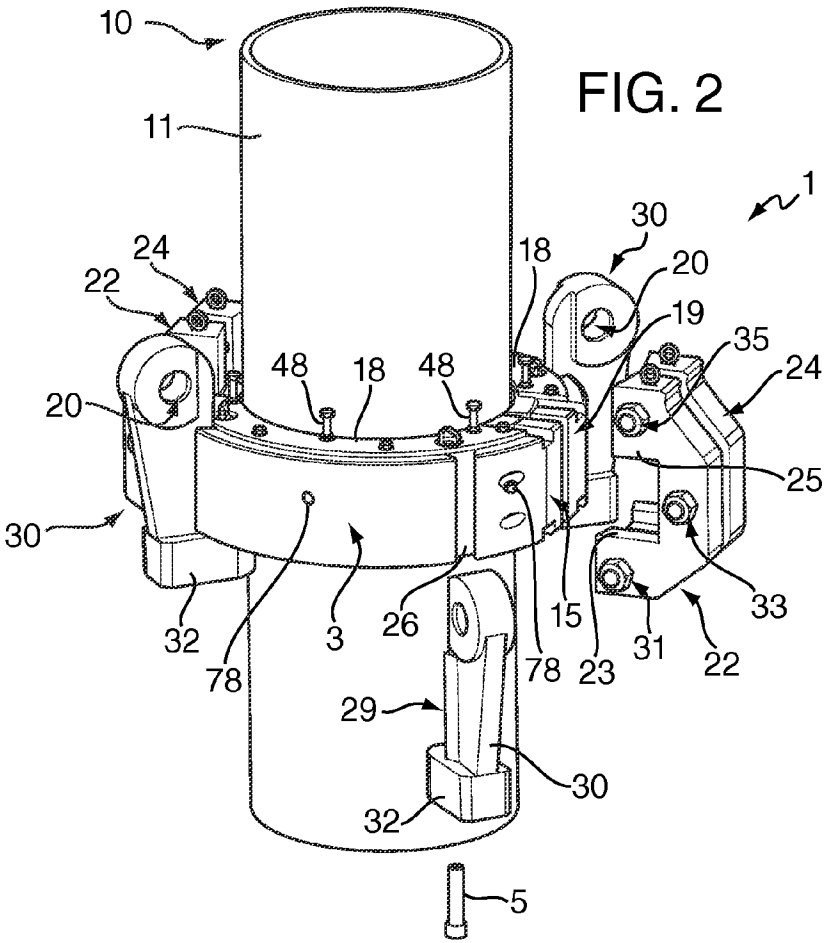
FIG. 2 is a view corresponding to FIG. 1 but showing in addition two pairs of clamp bodies for clamping together the collar segments and lifting lugs ready to be connected to the tension ring.
Figure 1:
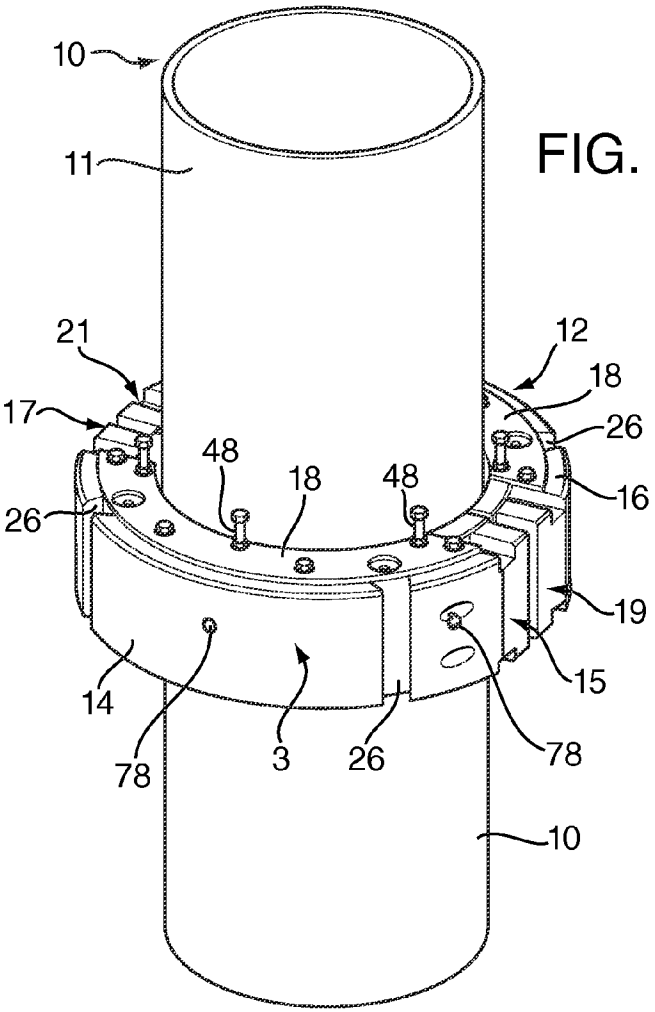
FIG. 1 is a perspective view of a tension ring for a tension ring lifting assembly according to a first preferred embodiment of the invention having a segmented collar that surrounds a plurality of gripping slip segments after initial securing by bolts during mounting around a pipe.
Figure 3:
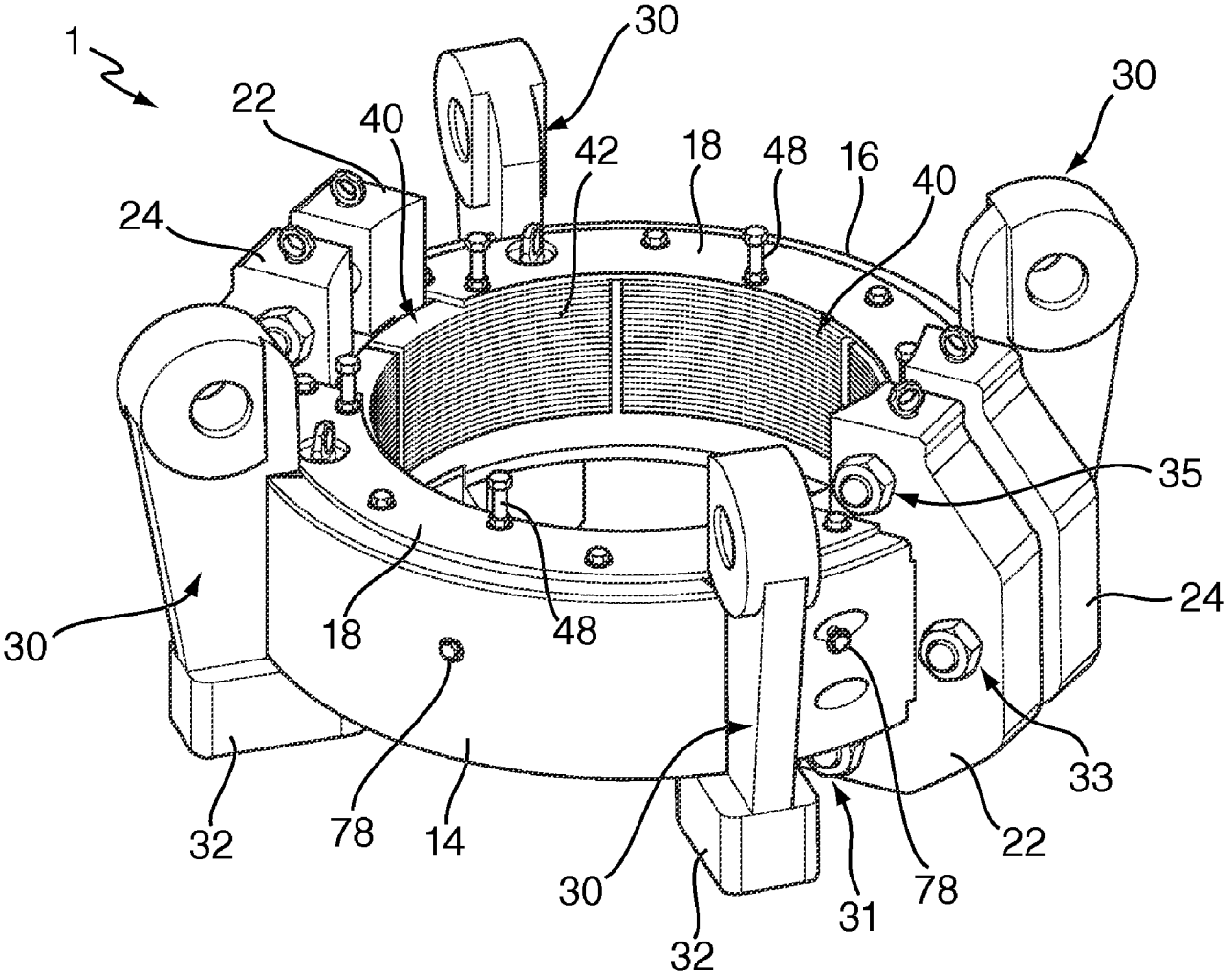
FIG. 3 is a view of an tension ring lifting assembly after the lifting lugs have been connected to the tension ring of FIG. 1, shown without the pipe in place.

FIG. 1 shows a conductor pipe 10, for example for an oil or gas production installation, having a cylindrical outer surface 11 that is surrounded by a first embodiment of a tension ring indicated generally at 12. FIG. 2 shows how the tension ring 12 is assembled with a number of clamp bodies 22, 24 and lifting lugs 30 to form a tension ring lifting assembly 1, illustrated for the sake of clarity in FIG. 3 in isolation from the pipe 10.

The tension ring 12 comprises a collar made up of two arc-shaped collar segments, 14 and 16, each of which extends substantially around a half circle. An arc-shaped retainer plate, 18 is fitted on each of the collar halves. The arc of each collar half ends in a specially shaped end portion 15, 17, 19, 21 having a profile that is T-shaped in the circumferential direction. The T-shaped profile is adapted, as can be seen from FIG. 2, to receive one of a pair of clamp bodies 22, 24. These clamp bodies each have a pair of flanges 23, 25 that engage in the T-shaped section at the end 15, 17, 19, 21 of one of the two collar halves, 14, 16 and when the clamp bodies 22, 24 are tensioned against one another by means of three linking nuts and bolts 31, 33, 35, the collar halves 14, 16 are pulled tightly around the pipe 10.

Before the clamp bodies 22, 24 are put in place, the collar halves 14, 16 are secured to one another in a first stage by connecting screws 52 (see FIG. 8) which are inserted in a generally circumferential direction to provide an initial connection between the collar halves 14, 16. The screws 52 therefore provide means for tensioning adjacent collar segments against one another to secure the tensioning ring around the pipe.

The collar halves, 14, 16 also have in a cylindrical outer surface 3 dovetail slot recesses 26 for receiving lifting lugs 30 which, as can be seen from the exploded view in FIG. 2, have corresponding dovetailed tendons 29 which can be slid up into the slots 26 from below, with the lifting loads being carried against the underside of the collar halves 14, 16 by an enlarged boss 32 at the lower end of each of the lifting lugs 30. Each lifting lug 30 is secured to a collar segment 14, 16 by means of an axially extending bolt 5 that passes through a clearance hole (not shown) in the boss into a threaded bore (not shown) in the collar segment. Each lifting lug has an eye 20 to which lifting gear may be attached, for example a shackle (not shown).

Figure 4:
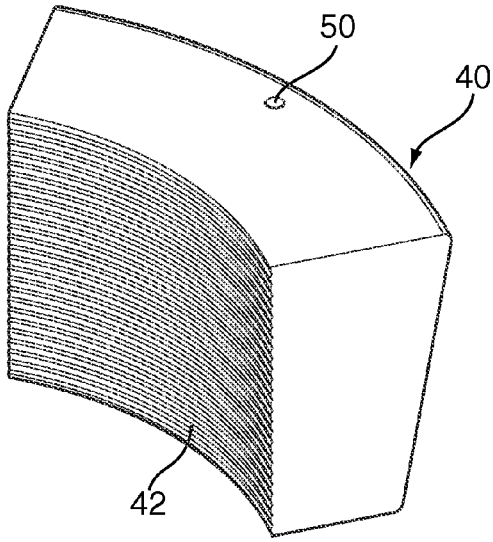
FIG. 4 shows a perspective view of a slip segment of FIG. 1.
Figure 5:
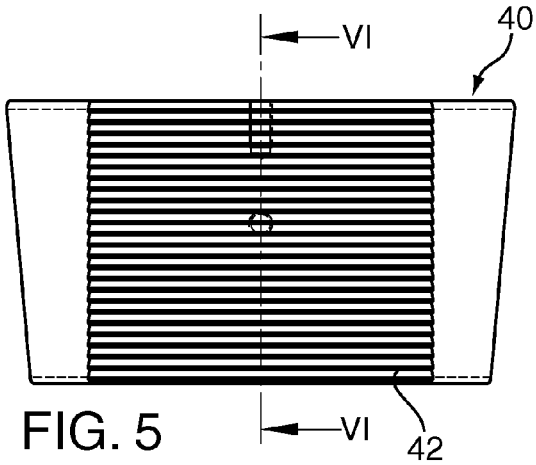
FIG. 5 is a plan view of the inside of the slip segment of FIG. 4.
Figure 6:
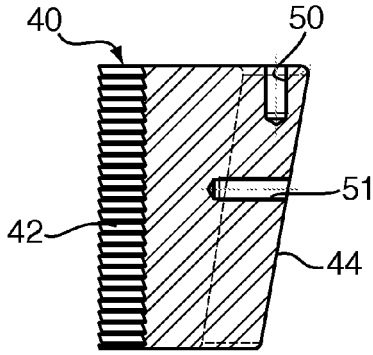
FIG. 6 is a cross-section view of the slip segment, taken along line VI-VI or FIG. 5.

Within the diameter of the collar halves 14, 16 a number of cylindrical wedge slip segments 40 are provided. One such segment is shown on its own in FIGS. 4 to 6 and it will be appreciated that sufficient segments will be provided to surround the circumference of the pipe 10. By replacing one set of slip segments 40 with another set of different thickness, the same tension ring 12 can be used to fit a range of different pipe diameters.

Figure 7:
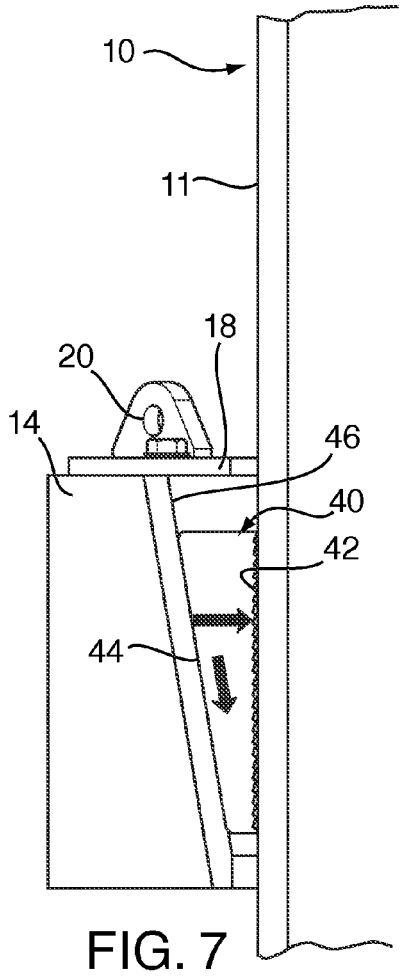
FIG. 7 is a cross-section showing part of the assembled tension ring of FIG. 3, showing how one slip segment is driven inwards by tensioning to grip the pipe.

As can be seen particularly in FIG. 7, the inner face of each segment 40 has a ridged surface 42, and the outer face has an inclined surface 44. In this example, the incline is at 20° to the axis of the tension ring 12. The collar halves 14, 16 each have a corresponding inner face having an inclined surface 46 and it will be seen that as the slip segments 40 drop down inside the collar segments, under gravity, the presence of the inclined surfaces means that the ridged surfaces of the slip segments 40 come into gripping contact with the outer wall surface 11 of the pipe 10.

When the tension ring 12 is first fitted around the pipe 10, the slip segments 40 are held in an uppermost position, by two retention bolts 48, 78. One retention bolt 28 extends axially to engage in a threaded bore 50 in a top surface 27 of the slip segment, and the other retention bolt 78 extends radially inwards to engage in a threaded bore 51 in the inclined surface 44 of the slip segment.

FIGS. 8 to 11 show four sequential stages in the use of this tension ring lifting assembly 1.

Figure 8:
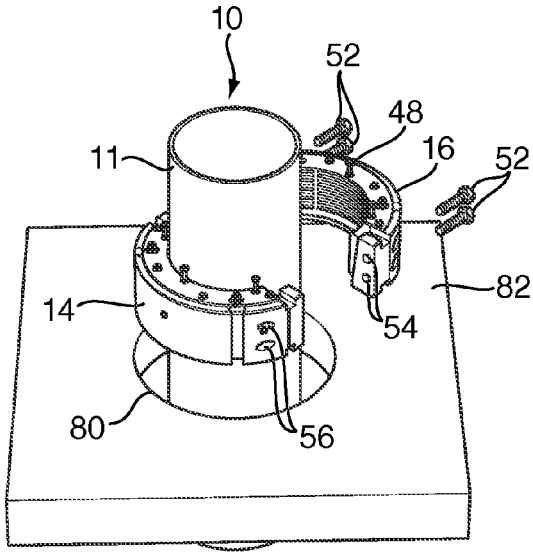
FIGS. 8 to 11 show sequential steps in the assembly of the tension ring lifting assembly according to the first preferred embodiment of the invention, and in particular how the tension ring can be inserted through a hole in a plate prior to attachment of the clamp bodes and lifting lugs to the collar segments.

FIG. 8 shows the two collar halves 14, 16 separated, with the first stage of assembly being the use of connecting screws between the collar halves 14, 16, as indicated at 52. These connecting screws pass through circumferential bores 54 between the collar halves and are secured either by screwing into threaded bores 56 on the opposite collar half, or by being received in nuts (not shown) held in place by the other collar half. At this stage the slip segments 40 are held in their uppermost position, away from the pipe wall surface 11, by the retaining bolts 48, 78.

Figure 9:
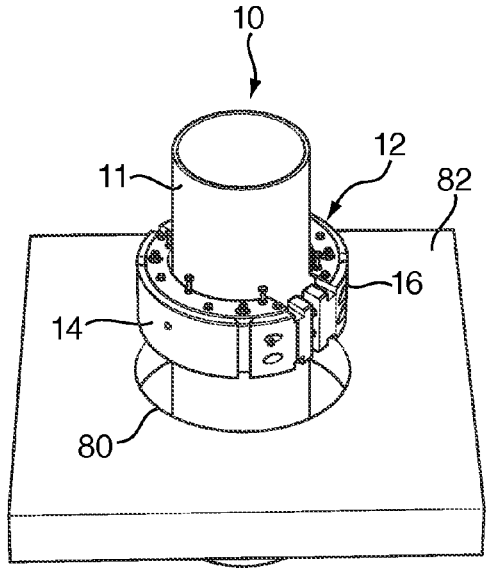

FIG. 9 shows the tension ring 12 assembled around the pipe 10. The axial and radial retention bolts 48, 78 can then be removed, so that the slip segments 40 drop under gravity, in an axial direction and move radially inwards into contact with the pipe surface 11, The connecting screws 52 are then tightened to provide an initial frictional grip between the collar halves 14, 16 and the outer surface 11 of the pipe 10.

During this initial tightening, the contacting inclined surfaces 44, 46 slide along each other, causing a corresponding radial inwards movement of each of the ridged surfaces 42 which then make direct contact with and begin to dig into the outer surface 11 of the pipe 10. The position of the tension ring 12 on the pipe is now fixed.

Figure 10:
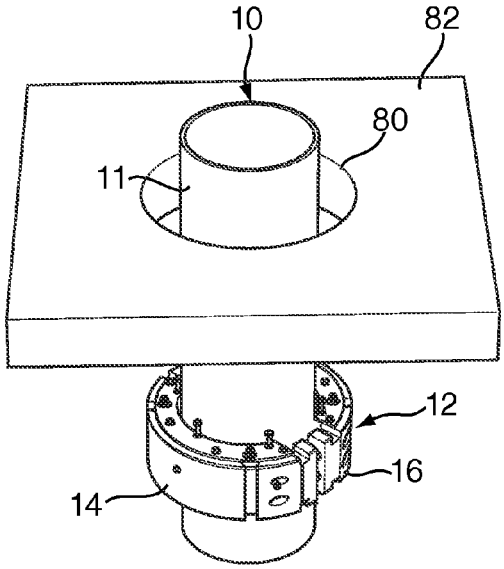
Figure 11:
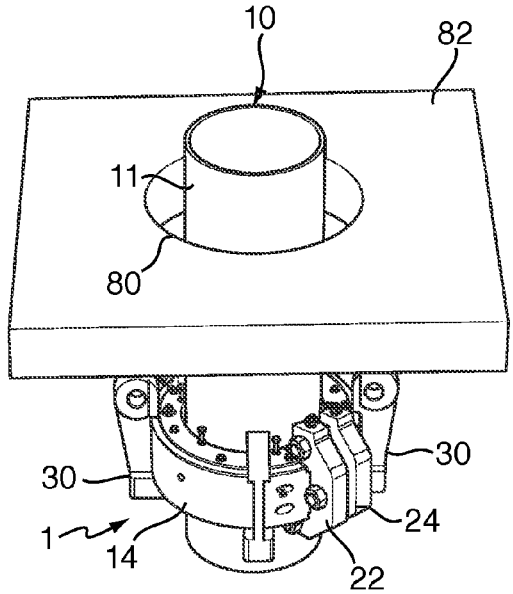

As shown in FIG. 10, the pipe 10 with the tension ring 12 fitted on it can then be lowered through a through hole or opening 80 in a rotary table 82 (the table is shown only schematically). As shown in FIG. 11, once the tension ring 12 has passed through the hole, the clamp bodies 22, 24 can be engaged with the shaped end regions 15, 17, 19, 21 of each collar half 14, 16, and the bolts 52 passing through each pair of clamp bodies can be torqued up to pull the clamp bodies against one another to further tension the tension ring and ensure a full and secure grip of the tension ring around the pipe 10. The ribs 42 on the slip segments 40 at this stage dig into and make a positive grip against the pipe surface 11. The yield depth into the surface of the pipe is enough to form a positive grip but not enough to structurally damage the pipe.

Finally, lifting lugs 30 are fitted in the dovetail slots 26 to form the tension ring lifting assembly 1, and in this assembled configuration, the weight of the conductor pipe 10 can be taken by attaching suitable lifting equipment to the lugs 30. It will then be noted that when the weight of the pipe is taken through the lifting lugs, the engagement between the segments and the pipe wall will tend to drive the slip segments down the inclined faces 46 of each collar half 14, 16 to increase the grip of the slip segments on the pipe wall 11.

It will be apparent from FIG. 11 that the tension ring lifting assembly 1, with the clamps 22, 24 and lifting lugs 30 attached, would be too large in diameter to be able to pass through the opening 80 in the rotary table 82. However the tension ring 12 without the clamps 22, 24 and lugs 30 can pass through the opening. As a result, the tension ring 12 can be located accurately on the pipe 10 whilst above the rotary table 82, and then the final fixing can be completed below the rotary table. This can give a great time-saving in uses of a tension ring lifting assembly 1 of the type described.

If needed, the lifting lugs 30 and clamp bodies 22, 24 may be removed from the tension ring 12. This may be necessary, for example, if different lifting gear is to be used to lift the conductor pipe 10 or if the tension ring lifting assembly 1 is to be removed from the conductor pipe 10.

Figure 12:
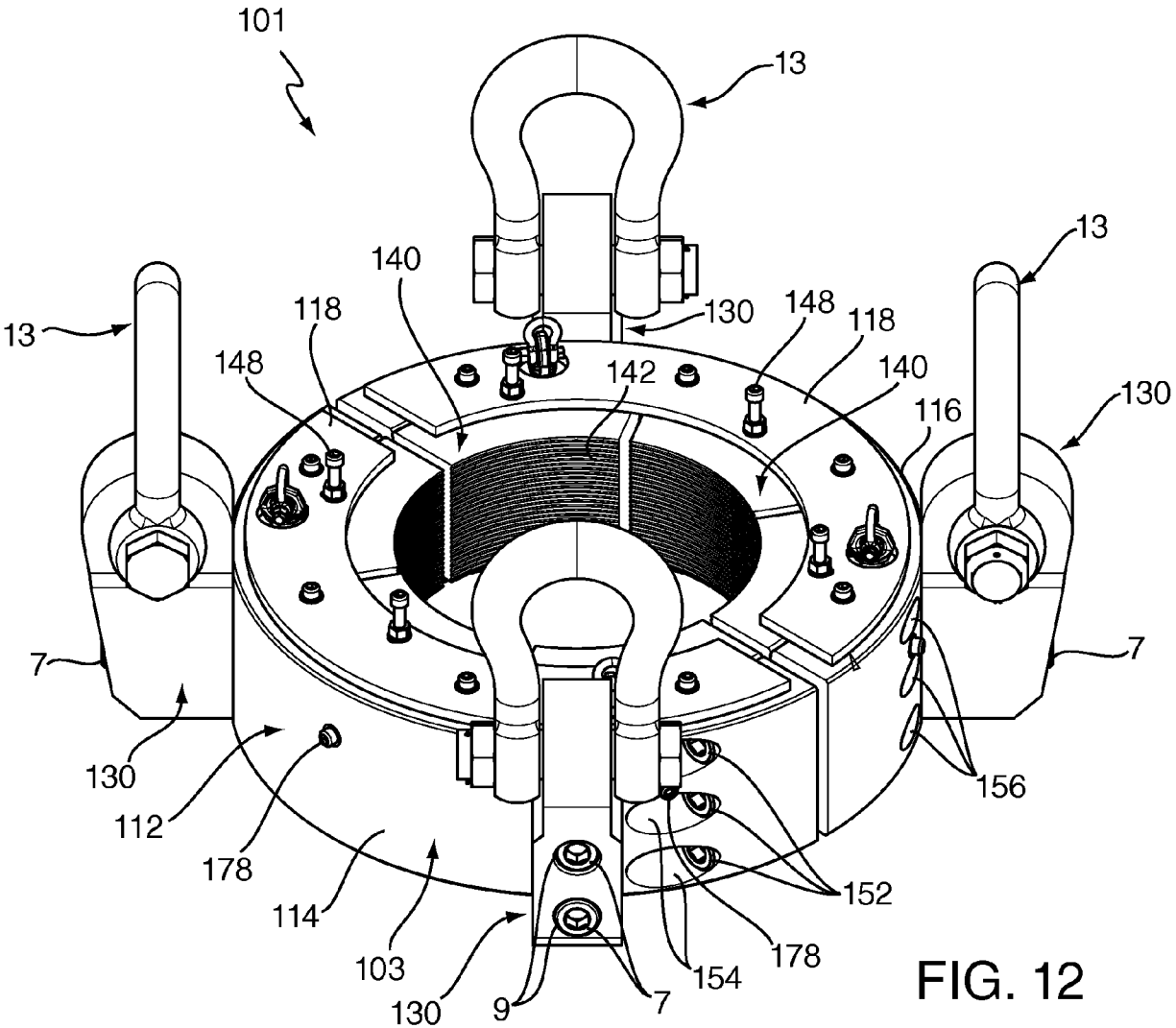
FIG. 12 is a perspective view of a tension ring lifting assembly according to a second preferred embodiment of the invention, shown without the pipe in place, having a segmented collar that surrounds a plurality of gripping slip segments after final securing by bolts that extend between adjacent collar segments.
Figure 13:
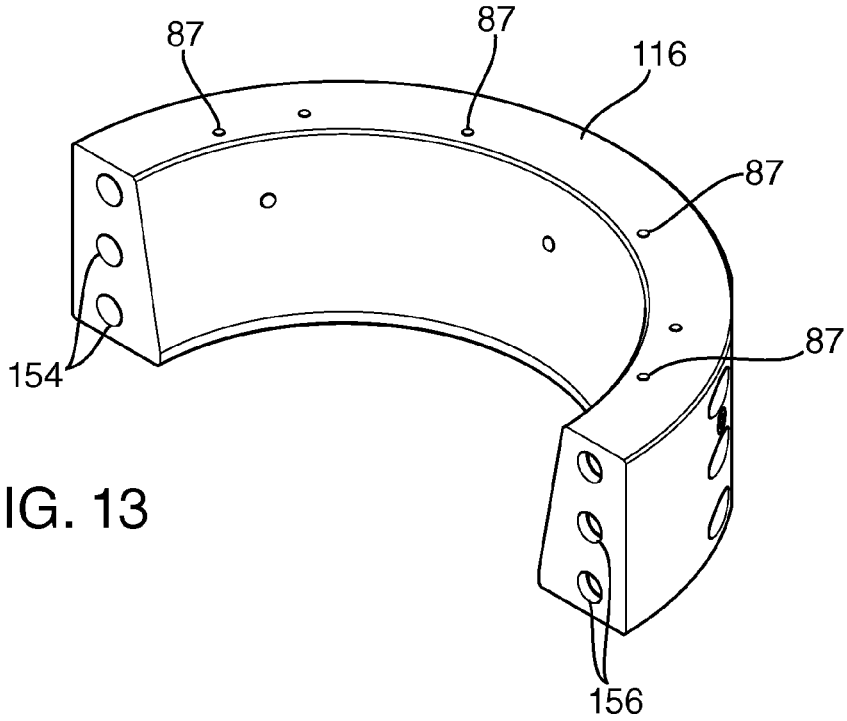
FIG. 13 is a perspective view of a collar segment of FIG. 12.

FIG. 12 shows a second embodiment of a tension ring lifting assembly 101, in which features similar to those of the first embodiment 1 are indicated with reference numerals incremented by 100.

The second embodiment differs from that described above in the way adjacent collar segments 114, 116 are tensioned against one another to secure the tensioning ring 112 around the pipe, and in the way lifting lugs 130 are removeably mounted to the to the tension ring.

The means for tensioning adjacent collar segments 114, 116 against one another is here provided by three bolts 152 that pass in a circumferential direction through clearance bores 154 in one collar segment 114 to engage with a threaded bore 156 in the other collar segment 116. The bores 154, 156 are shown more clearing in FIG. 6, which shows one of the collar segments 116 in isolation. From this it can be seen that this arrangement is duplicated on the far side of the tension ring 112 shown in FIG. 12. The six bolts 152, when each is torqued to a specified torque, provide sufficient compression that there is no need for the clamp bodies 22, 24 of the first embodiment in order to provide sufficient grip to enable the tension ring lifting assembly 101 to lift a typical conductor pipe.

Figure 14:
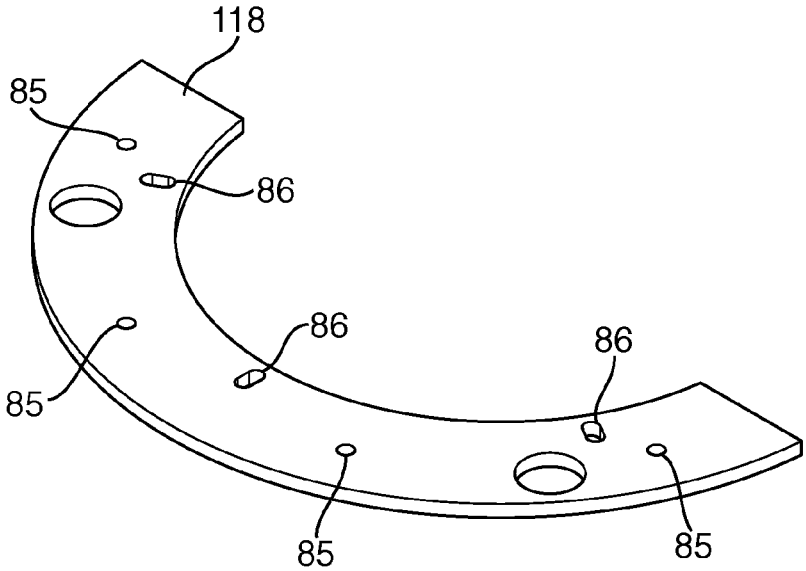
FIG. 14 is a perspective view of a retainer plate that is used to secure slip segments, prior to use of the tension ring lifting assembly.

FIG. 14 shows in isolation one of the retainer plates 118. This has a number of clearance bores 85, 86, some of which align with threaded bores 87 in the collar segments by which the retainer plate is bolted to the collar segment, and some of which 85 align with the bores 50 (FIG. 6) in the slip segments 140 so that the retention bolts 148 may pass freely through the retainer plate 118. As can be seen in FIG. 14, the bores for the retention bolts 148 are oblong in the radial direction so that these bolts may if wanted be kept secured to the slip segments 140 as the slip segments are tightened radially inwards.

Figure 15:
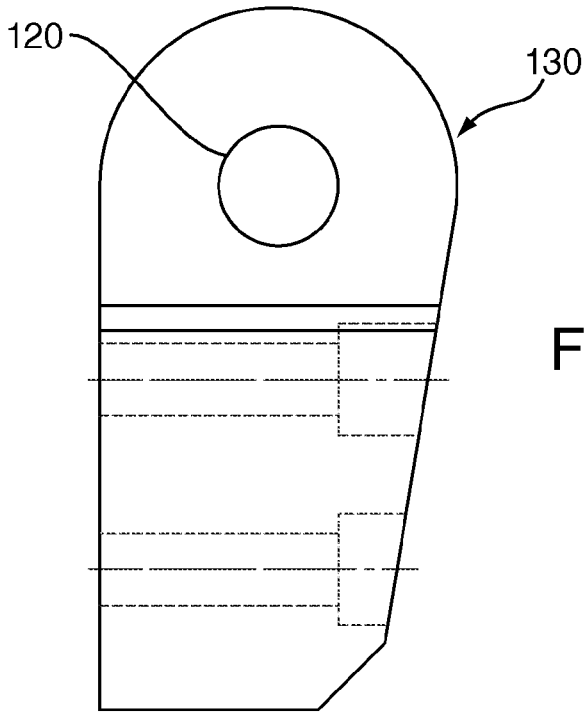
FIGS. 15 to 17 are views of lifting lugs of FIG. 12.
Figure 16:
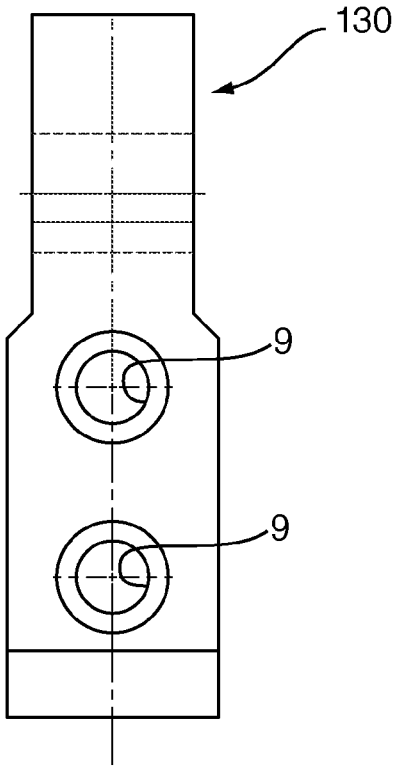
Figure 17:
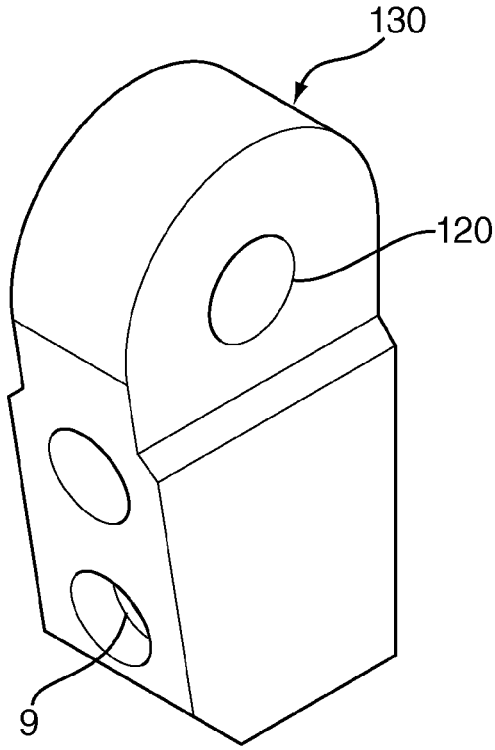

The tension ring lifting assembly 101 may therefore be fully connected to the pipe prior to passing the assembly through a hole 80 in a rotary table plate 82, as illustrated in FIG. 10. This simplifies the operation of securing the lifting assembly to the pipe, as then it is only necessary to fit the lifting lugs to the tension ring 112. It would be possible to use the lifting lugs 30 of the first embodiment with the tension ring 112 of the second embodiment, however, in this example, the lifting lugs 130, shown in isolation in FIGS. 15 to 17, are removeably fixed to the outer cylindrical surface 103 of the collar segments 114, 116 by means of two bolts 7 that pass through a corresponding clearance bores 9 in each of the lugs 130 to engage with threaded bores (not shown) in the collar segments 114, 116.

As there are four lugs 130 in this example, there are eight bolts 7 used to connect the lugs to the collar segments 140. Each bolt has a specified torque and each lug is capable of bearing 110 Tonnes.

A shackle 13 is attached to the eye 120 of each one of the lugs 130 by which lifting gear (not shown) may be connected to the tension ring lifting assembly 101.

Figure 21:
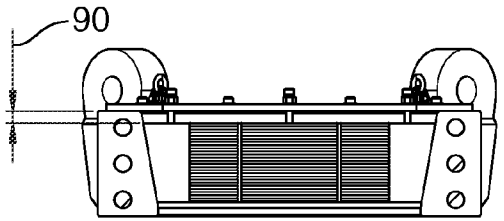
FIG. 21 is a cross-section through the tension ring lifting assembly, taken along line XXI-XXI of FIG. 20.
Figure 20:
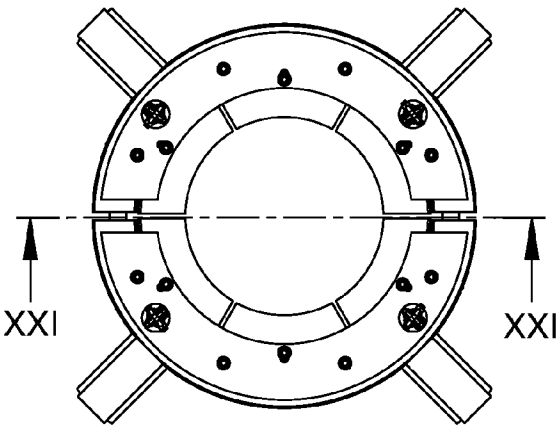
FIG. 20 is a top plan view of the tension ring lifting assembly of FIG. 12, after the slip segments have each been released from the retaining bolts and after the collar segments have been tensioned to drive the slip segments down and radially inwards.
Figure 19:
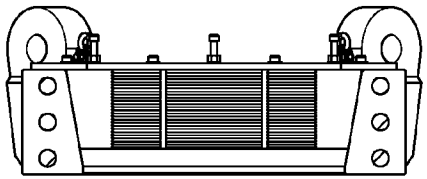
FIG. 19 is a cross-section through the tension ring lifting assembly, taken along line XIX-XIX of FIG. 18.
Figure 18:
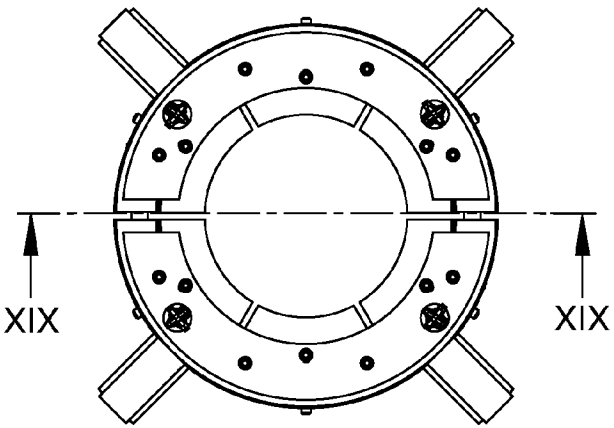
FIG. 18 is a top plan view of the tension ring lifting assembly of FIG. 12, prior to use and with the slip segments each secured by two retaining bolts.

FIGS. 19 to 21 show how the components of the tension ring lifting assembly 101 move during the final tightening of the connecting screws 152. In this example, the tension ring lifting assembly 101 is designed for connection to a conductor pipe 10 having a nominal diameter of 24 inches±1% (610±6 mm). The collar segments are therefore adjustable over a diameter range of 12 mm, and as shown in FIG. 21 this equates to an axial adjustment range 90 of 36.8 mm.

As with the first embodiment, the tension ring 112 can be located accurately on the conductor pipe whilst above the rotary table, and then the final fixing of the lifting lugs can be completed below the rotary table. The invention therefore enables the tension ring to be fitted with a relatively small outer diameter so that the tension ring can pass through an opening before the lifting lugs are fitted. This can give a great time-saving in uses of the tension ring lifting assemblies 1, 101 of the types described.

It is to be recognized that various alterations, modifications, and/or additions may be introduced into the constructions and arrangements of parts described above without departing from the spirit or scope of the present invention, as defined by the appended claims.

What is claimed is:

1. A tension ring lifting assembly for securing around a pipe, the assembly comprising a tension ring and at least one lifting lug by which the tension ring, and a pipe around which the tension ring has been secured, can be lifted, the tension ring comprising:

a plurality of collar segments which can be assembled into a ring around the pipe;

a plurality of slip segments adapted to fit between the collar segments and the pipe and to make direct contact with the pipe surface, the collar segments and the slip segments when assembled having inclined contacting surfaces such that an inner diameter across said ring, between the inner faces of the slip segments, varies as the slip segments move up and down inside said collar segments;

means for tensioning adjacent collar segments against one another to secure said ring around the pipe; and means for removeably mounting said at least one lifting lug to the tension ring;

wherein, prior to mounting of said at least one lifting lug, the tension ring has an outer diameter that is less than the diameter of the tension ring lifting assembly after mounting of said at least one lifting lug to the tension ring.

2. A tension ring lifting assembly as claimed in claim 1, in which the means for removeably mounting said at least one lifting lug to the tension ring comprises at least one bolt and at least one corresponding threaded bore in a collar segment by which said at least one lifting lug can be removeably bolted to said collar segment.

3. A tension ring lifting assembly as claimed in claim 1, in which the means for removeably mounting said at least one lifting lug to the tension ring comprises at least one recess in a collar segment and at least one mating projection in said at least one lifting lug by which said at least one lifting lug can be removeably affixed to said collar segment.

4. A tension ring lifting assembly as claimed in claim 3, wherein the recess is a vertically extending dovetail slot and the lug has a corresponding dovetail formation which can slide into the recess from below but which end in a base which will not enter the slot and through which a lifting load will be transferred to the tension ring.

5. A tension ring lifting assembly as claimed in claim 1, in which said means for tensioning adjacent collar segments against one another comprising at least one screw fixing which when tightened pulls said adjacent collar segments together.

6. A tension ring lifting assembly as claimed in claim 1, comprising additionally at least one pair of clamp bodies which can be engaged with each other and with two adjacent collar segments and tensioned against one another to further secure the collar segments around the pipe.

7. A tension ring lifting assembly as claimed in claim 6, wherein the collar segments have enlarged shoulders at their adjoining ends, and said clamp bodies locate against the shoulders to pull the collar segments towards one another.

8. A tension ring lifting assembly as claimed in claim 6, wherein the clamp bodies are provided with bolts which can be tightened to draw the clamp bodies towards one another.

9. A tension ring lifting assembly as claimed in claim 7, wherein the clamp bodies are provided with bolts which can be tightened to draw the clamp bodies towards one another.

10. A tension ring lifting assembly as claimed in claim 1, wherein there are two collar segments, each in the form of an annular arc extending over a semi-circle.

11. A tension ring lifting assembly as claimed in claim 1, in which the tension ring further comprises a retaining plate associated with each collar segment, and means in the retaining plates to support the slip segments in their uppermost position when initially locating the ring around a pipe.

12. A tension ring lifting assembly as claimed in claim 1, in which the means for tensioning adjacent collar segments against one another to secure the tension ring around the pipe is adapted to provide a pre-tension of the collar segments prior to full tensioning of the collar segments so that slip segments are held in direct contact with the pipe surface prior to removeably mounting said at least one lifting lug to the tension ring.

13. A tension ring lifting assembly as claimed in claim 12, in which the means for pre-tensioning the collar segments comprises at least one bolt that pulls adjacent collar segments together.

14. A method of securing a tension ring lifting assembly around a pipe, the assembly comprising a tension ring and at least one lifting lug by which the tension ring, and a pipe around which the tension ring has been secured, can be lifted, the method comprising:

assembling a plurality of collar segments into a ring around the pipe;

fitting a plurality of slip segments between the collar segments and the pipe to make direct contact with the pipe surface, the collar segments and the slip segments when assembled having inclined contacting surfaces such that an inner diameter across said assembled ring, between the inner faces of the slip segments, varies as the slip segments move up and down inside said assembled collar segments;

tensioning adjacent collar segments against one another to secure said ring around the pipe;

providing an apparatus separate from the tension ring lifting assembly, said apparatus having a body and in the body a through hole;

passing said secured tension ring and pipe through said hole and then mounting said at least one lifting lug to the tension ring to complete the assembly of the tension ring lifting assembly;

wherein, after said mounting of said at least one lifting lug, the tension ring has an outer diameter that is greater than the diameter of the tension ring lifting assembly prior to mounting of said at least one lifting lug to the tension ring such that the secured tension ring lifting assembly and pipe may not pass back through said through hole.

15. A method as claimed in claim 14, in which the method includes after passing said secured tension ring and pipe through said hole, the step of applying additional tension between adjacent collar segments to further secure the tension ring around the pipe.

* * * * *